US005716005A

United States Patent [19]

McMahan

[11] Patent Number: 5,716,005

[45] Date of Patent: Feb. 10, 1998

[54] SOAP DISPENSING SHOWER UNIT

[76] Inventor: James W. McMahan, 1008 Morgan Landing Dr., Dunwoody, Ga. 30350

[21] Appl. No.: 513,256

[22] Filed: Aug. 4, 1995

[51] Int. Cl.[6] ..... B05B 7/28

[52] U.S. Cl. ..... 239/315; 239/391; 239/413; 239/530; 239/569; 239/305; 239/318

[58] Field of Search ..... 239/303–305, 239/307, 310, 315–318, 390, 391, 397, 413, 433, 530, 569; 4/601, 903, 597, 605

[56] References Cited

U.S. PATENT DOCUMENTS

| | | | |
|---|---|---|---|
| 1,532,809 | 4/1925 | Girard | 239/315 X |
| 2,616,660 | 11/1952 | Morehouse . | |
| 2,624,619 | 1/1953 | Fletcher et al. . | |
| 2,975,804 | 3/1961 | Dunn et al. | 239/305 X |
| 3,003,703 | 10/1961 | Lambton | 239/315 X |
| 3,039,492 | 6/1962 | Brucker | 239/315 X |
| 3,318,535 | 5/1967 | New . | |
| 3,581,998 | 6/1971 | Roche | 239/310 X |
| 4,171,169 | 10/1979 | Williams | 239/315 X |
| 4,696,593 | 9/1987 | Bayless | 239/310 X |
| 4,998,836 | 3/1991 | Scripnick | 239/310 X |
| 5,004,158 | 4/1991 | Halem et al. | 239/310 |
| 5,109,553 | 5/1992 | Kishimoto | 239/304 X |
| 5,174,503 | 12/1992 | Gasaway | 239/307 |
| 5,339,469 | 8/1994 | Gilles | 4/601 |

FOREIGN PATENT DOCUMENTS

| | | | |
|---|---|---|---|
| 2702872 | 7/1978 | Germany | 239/304 |
| 4122861 | 1/1993 | Germany | 239/315 |
| 2137902 | 10/1984 | United Kingdom | 239/315 |

*Primary Examiner*—Lesley D. Morris

*Attorney, Agent, or Firm*—Beveridge, DeGrandi, Weilacher & Young, LLP

[57] ABSTRACT

A soap dispensing shower unit includes a base member which has plural shower head unit supporting members and plural soap container supporting members. Several soap supply containers are held by the soap container supporting members, and plural shower head units are held by the shower head unit supporting members. A soap dispensing shower head is included with the shower unit. This shower head includes a support with a shower head detachably fit to one end and a water supply pipe connector at the other end. A valve arrangement is provided with the support. This valve arrangement includes a soap supply line, a soap valve, a water supply line, a water valve and a junction where the soap supply line and the water supply line merge together. The soap valve and water valve may be selectively activated to supply soap only, water only, or a mixture of soap and water. Liquid soap is fed from the supply container to the soap supply line by a venturi feed arrangement or by a gravity feed arrangement. The support of the shower head may be in the form of a hand grip, wherein the valve arrangement is provided in the hand grip. The soap supply container may be provided at least partially in the hand grip.

20 Claims, 4 Drawing Sheets

FIG. 1
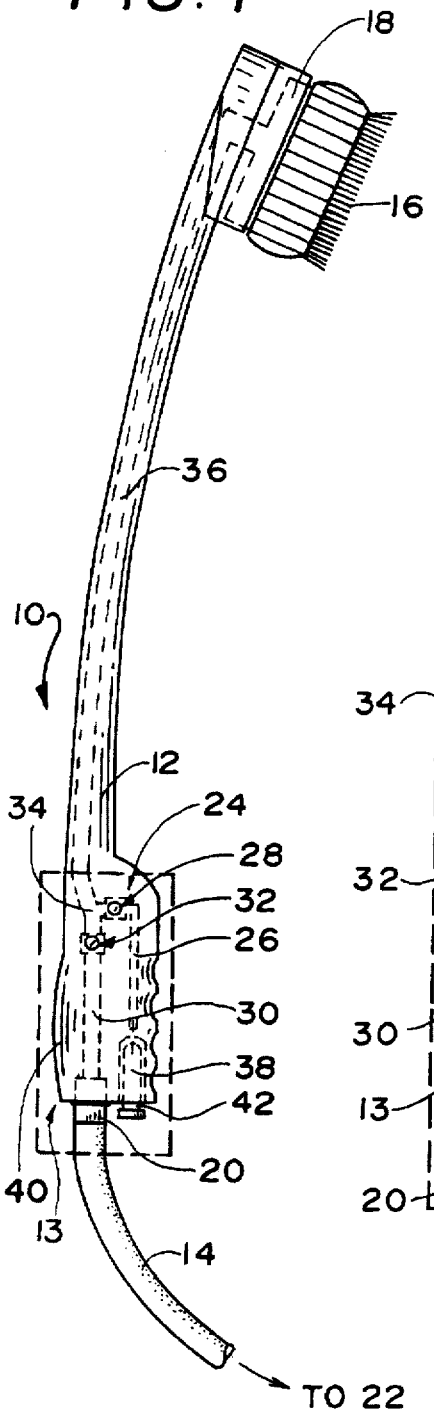
FIG. 2
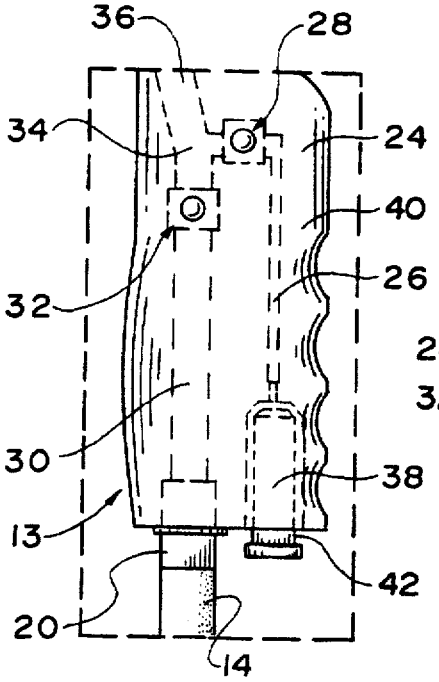
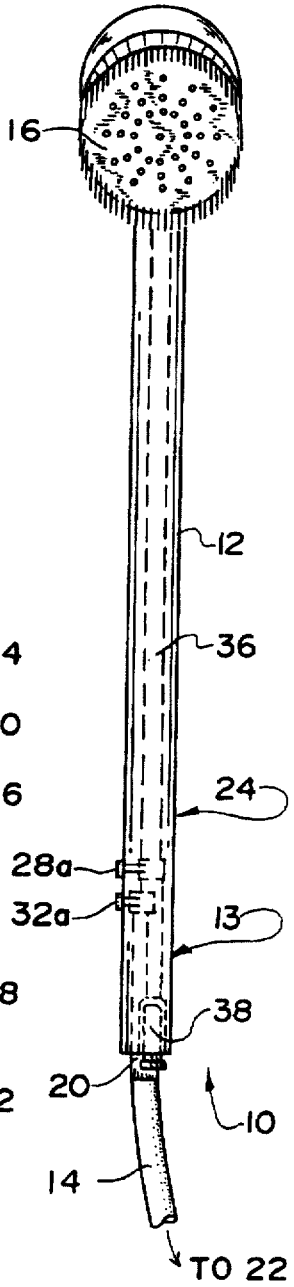
FIG. 3

SOAP DISPENSING SHOWER UNIT

BACKGROUND OF THE INVENTION

The invention relates to a soap dispensing shower unit. Various soap dispensing shower head arrangements are known in the art, such as those illustrated in U.S. Pat. No. 3,581,998 (Roche), U.S. Pat. No. 4,998,836 (Scripnick), U.S. Pat. No. 5,004,158 (Halem et al.), and U.S. Pat. No. 5,174,503 (Gasaway). However, the devices illustrated in these patents include long soap hoses which are difficult to clean and wasteful of liquid soap. Furthermore, some of the illustrated devices include bulky and complicated systems which would be difficult to install and maintain.

SUMMARY OF THE INVENTION

It is an object of this invention to provide a compact soap dispensing shower head which requires little or no cleaning. It is further an object of this invention to provide a soap dispensing shower head which is easy and inexpensive to install, using simple hand tools. Another object of the invention is to provide a soap dispensing shower head wherein the soap containers are readily interchangeable, while realizing a reduced liquid soap waste.

The soap dispensing shower head of the invention includes a soap container located at least partially within the hand grip unit of a shower head support. The soap containers are easily interchangeable, allowing for selective supplying of soap, shampoo, conditioner or other fluids during a shower.

In accordance with the invention, a soap dispensing shower head includes a support having a hand grip unit. The support has a first end and a second end. A shower head unit is detachably fit to the first end of the support, and a connector provided at the second end of the support is adapted to attach to a water supply pipe. A valve arrangement is provided proximate the second end of the support. The valve arrangement includes: a soap supply line defined at least partially within the hand grip unit; a soap valve provided in the soap supply line; a water supply line defined at least partially within the hand grip unit; a water valve provided in the water supply line; and a junction defined in the support where the soap supply line and the water supply line merge together to provide a single fluid supply line. In accordance with the invention, the soap valve and the water valve may be selectively activated to supply soap only, water only, or a mixture of soap and water.

A soap supply container is detachably received in the hand grip unit and connected to the soap supply line. In accordance with the invention, the liquid from the soap supply container may be fed through the soap supply line by a venturi feed arrangement, by a gravity feed arrangement, or by a capillary feed arrangement. The soap/emollient delivery system may combine the capillary, venturi and gravity feeding arrangements.

The support of the shower head includes a hand grip unit, and this hand grip unit may be connected to a flexible hose that is connected to the water supply pipe. In this manner, the complete valve arrangement may be located within the hand grip unit. The junction preferably is provided within the hand grip unit, although it may be located at another position in the support. A soap supply container is detachably received in the support (e.g., in the hand grip unit) and connected to the soap supply line.

The invention also relates to a soap dispensing shower unit. In the shower unit, a soap dispensing shower head is included as described above. In addition, the shower unit includes a base member which has a plurality of shower head unit supporting members and a plurality of soap container supporting members.

Plural soap supply containers may be received in the soap container supporting members of the base member. These soap supply containers may contain various different liquid products, such as liquid soap, shampoo, conditioner, lotions, medications, or other emollients. In this manner, various liquid products are readily available to the user during a shower, and these products can be readily attached to the soap supply line, as needed by the user.

Similarly, plural shower head units may be received in the various shower head unit supporting members of the base member. For example, various shower heads, brush attachments, sponges, loofahs, scouring heads, debriding sponges or heads may be provided on the supporting member. The shower head units are detachably fit to the support of the shower head so that different shower head units may be substituted on the support by the user during a shower. Also, it is preferred that the brushes, loofahs and other shower head units be disposable so they may be discarded by the user and readily replaced.

One advantageous aspect of the invention is that the unit is passive in that it does not require a separate water reservoir, water preparation unit, water heater, water pump, or the like. The shower head device attaches to conventional water supply lines which are presently stubbed-in to most residential units in the U.S. and other countries.

BRIEF DESCRIPTION OF THE DRAWINGS

The invention will be more fully described in the following detailed description, which description will be better understood when considered in view of the attached drawings, wherein:

FIG. 1 is a side view of a soap dispensing shower head according to the invention;

FIG. 2 is an enlarged view of the hand grip unit and valve mechanisms of the shower head illustrated in FIG. 1;

FIG. 3 is a front view of the shower head of FIG. 1;

DETAILED DESCRIPTION OF THE INVENTION

Figure 7:
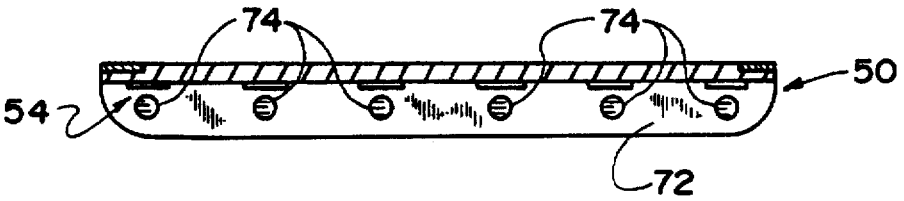
FIG. 7 is a sectional view of the base member taken along line 7—7 in FIG. 4.
Figure 6:
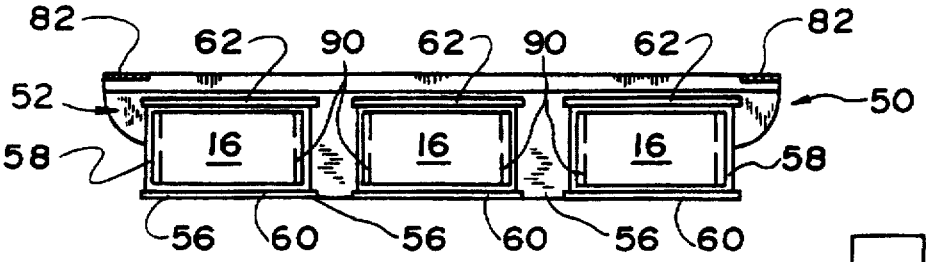
FIG. 6 is a top view of the base member of FIG. 4.

The soap dispensing shower head and the soap dispensing shower unit according to the invention are illustrated in FIGS. 1–9. The soap dispensing shower head is shown generally by reference number 10 in FIGS. 1 and 3. The shower head 10 includes a support 12, which includes a hand grip unit 13. The support 12 including the hand grip unit 13 is preferably made from injection molded plastic or otherwise fabricated from plastic, although other suitable construction materials may be used. A flexible hose 14 is attached to the hand grip unit 13 so that the user may freely change the position of the shower head 10. The flexible hose 14 may be any suitable length, and typically, about four feet of flexible hose is suitable.

Suitable flexible hoses 14 for use in this invention may be fabricated in many ways and are commercially available. For example, the flexible hose 14 may include a pressure accepting clear plastic or flexible polyvinyl chloride (PVC) hose, surrounded and reinforced by ribbed or woven stainless steel material which will allow the hose to bend and flex.

At a first end of the support 12, an interchangeable and detachable shower head unit 16 is provided. The interchangeable and detachable shower head unit 16 typically has a round or oval dispersion surface including water outlet holes. The shower head units 16 are removably attached to the shower head support 12 through any suitable removable connector. For example, a bayonet type fitting 18 may be provided wherein raised ridges or projections on the shower head unit 16 fit into indentations or slots provided on the support 12 so that the shower head unit 16 may be readily attached to and removed from the support 12 by a twisting action. Such bayonet type fittings are conventional and well known to those skilled in the art.

Figure 8:
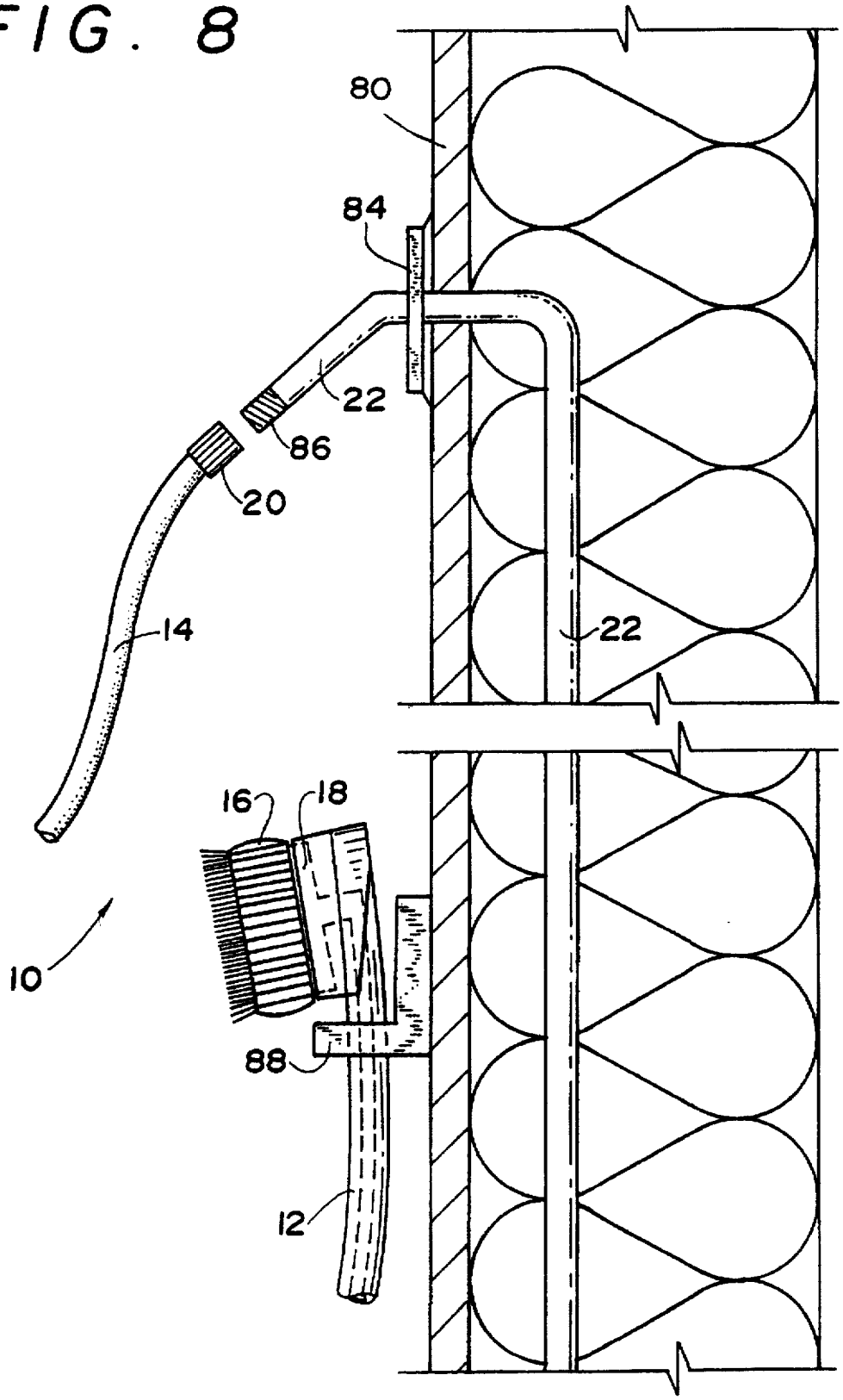
FIG. 8 is a view which illustrates the mounting of the shower unit in accordance with the invention.

The other end of the hand grip unit 13 includes a connector 20. Additionally, as illustrated in FIG. 8, the flexible hose 14 also includes a connector 20'. The connectors 20 and 20' may be standard, commercially available fittings, and the connector 20' connects to a water supply pipe 22 (e.g., via a standard male/female connector arrangement). The connectors 20 and 20' may be plastic, galvanized steel, or any other suitable material conventionally used in the art. The soap dispensing shower head according to the invention may be attached to conventional piping and plumbing included in homes, apartments, sports facilities, etc. There is no need for special plumbing to utilize the shower head according to the invention. Rather, this device can be easily installed on existing pipes using a simple wrench and screwdriver.

A valve arrangement is provided near the second end of the support 12 of the shower head 10, preferably within the hand grip unit 13. This valve arrangement is shown generally as reference number 24 in FIGS. 1–3. The valve arrangement 24 includes a soap supply line 26 and a soap valve 28 (e.g., a dedicated gate valve) provided near the first end of the soap supply line 26. The opposite end of the soap supply line 26 is in fluid communication with a soap supply container 38.

Additionally, the valve arrangement 24 includes a water supply line 30 and a water valve 32 (e.g., a dedicated gate valve) provided near the first end of the water supply line 30. The other end of the water supply line 30 connects to the flexible hose 14 via connector 20.

Any suitable valve structures can be utilized without departing from the invention, although dedicated gate valves are preferred. The hand grip unit 13 may include knobs or buttons 28*a* and 32*a* which are used to activate the valves 28 and 32, respectively, although other suitable valve activators may be used.

The soap supply line 26 and the water supply line 30 merge together at a junction 34, thus forming a single fluid supply line 36. By selectively manipulating the soap valve 28 and the water valve 32, the user may selectively supply soap only, water only, or a mixture of soap and water. The valves 28 and 32 also may be adjusted so as to control the relative amounts of soap and water in the liquid flow. Additionally, both valves 28 and 32 may be closed such that no liquid flows out of the shower head unit 16. This facilitates exchanging shower head units 16 during use of the shower.

The soap supply container 38 is arranged to be removably received at an insertion port located in a handle portion 40 of the hand grip unit 13. Any suitable arrangement can be used to secure the soap supply container 38 to the hand grip unit 13, such as a conventional bayonet fitting 42. The soap supply container 38 preferably is in the form of replaceable cartridges or vials, preferably made from plastic or other non-breakable material, which extend slightly from the hand grip unit 13 so that they are easily removable such that different soap supply containers 38 may be used during a shower. For example, a user might first use a soap supply container 38 filled with shampoo during the shower. Thereafter, the shampoo soap supply container 38 might be removed and replaced with a hair conditioner containing soap supply container 38, and the user can then proceed to condition the hair. Thereafter, the user might select a liquid soap containing soap supply container 38. Preferably, the soap valve 28 is switched off during exchange of the soap supply containers 38. The soap supply containers 38 may include various liquids, such as soap, shampoo, conditioner, lotions, medications, or other emollients, as noted above. The cartridges or vials are preferably color coded so as to enable easy identification of the contents of the vial. This promotes consumer confidence and enhances hygiene.

As one specific example, the soap supply container 38 may be a cylindrical shaped disposable two ounce container, about 1.5 inches in diameter and about 4–5 inches long.

Preferably, the length of the soap supply line 26 is kept quite short to prevent excessive waste of the various liquids in the soap supply containers. The connection between the soap supply line 26 and the soap supply container 38 may be made in any suitable way. For example, the soap supply line 26 may include a ventricle soap tube having a piercing end portion, with capillary, supply or vent openings, which extends down through a self sealing membrane provided on the soap supply container 38. Alternatively, the soap supply container 38 may include a nipple or other similar external attachment means so that the soap supply line 26 can be connected to the container 38.

Liquid may be withdrawn from the soap supply container 38 in any suitable manner, such as by a small pump, by gravity feed, by capillary feed, by venturi feed or the like. One preferred way of supplying or delivering the liquid is to take advantage of the venturi effect. As water passes through the water supply line 30, it also passes through the junction 34. This water in supply line 30 rushes past the smaller opening of the soap supply line 26. When the soap valve 28 is opened, this creates a vacuum in the soap supply line 26 that is sufficient to withdraw liquid from the soap supply container 38. Thus, liquid is pulled from the supply container 38, through the soap valve 28, into the junction 34, and into the single fluid supply line 36 with the water. This is a venturi feed arrangement. The relative amounts of water and liquid from the soap supply container 38 can be adjusted by manipulating valves 28 and 32. Additionally, more than one type of feeding arrangement can be used in the device. For example, the device in accordance with the invention may use a combination of capillary/gravity/venturi feed.

In another suitable arrangement, the soap supply container 38 could be located above the soap valve 28 so that the liquid from the container 38 is fed to the soap supply line 26 and to the single fluid supply line 36 by a gravity feed arrangement. For example, the containers 38 could be inserted through the top of the hand grip unit 13.

As another example, as a preferred embodiment for supplying soap alone when no water is being supplied, a thumb pump valve may be located at soap valve 28 and connected to the piercing end of the soap supply line 26. This thumb pump valve is preferably a self-lubricating pump, such as a Delron type pump, similar to simple fluid pumps used in commercially available water pistols or other emollient distributing pumps known in the art.

The soap supply line 26 may be easily cleaned by rinsing it with water under the tub faucet or otherwise pumping water through the valve arrangement 24.

Figure 4:
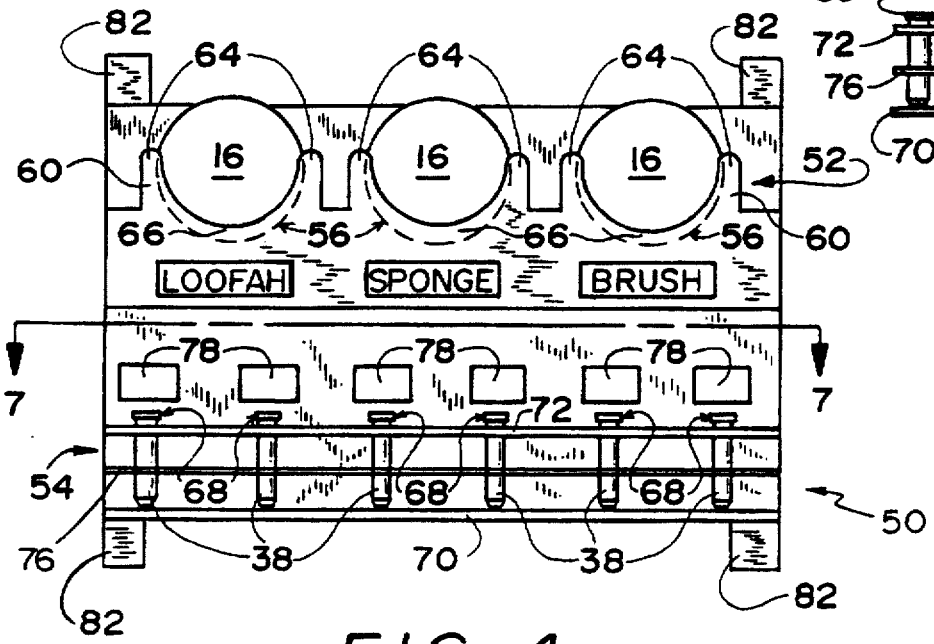
FIG. 4 is a front view of a base member of the soap dispensing shower unit according to the invention.

The soap dispensing shower unit in accordance with the invention will now be described in more detail in conjunction with FIGS. 4–7. The soap dispensing shower unit includes a soap dispensing shower head 10, such as that described above in connection with FIGS. 1–3. FIG. 4 shows a front view of the base member 50 of the soap dispensing shower unit of the invention. The base member 50 includes an upper section 52 and a lower section 54.

In the illustrated embodiment, the upper section 52 is provided with a plurality of shower head unit supporting members 56. As more clearly shown in the side view of FIG. 5 and the top view of FIG. 6, the shower head unit supporting members 56 include a bottom surface 58 and side surfaces 60 and 62. End restraining means 90, such as bars, wires or walls, prevent the shower head units 16 from rolling out of the supporting members 56. FIG. 4 shows a preferred embodiment wherein the front side surface 60 of each supporting member 56 includes raised edge portions 64 connected by a rounded, lower central portion 66. This feature facilitates easy removal and replacement of the shower head units 16 with respect to the base member 50 during use of the shower.

As shown in FIG. 4, labels may be provided corresponding to each shower head unit supporting member 56 to describe the shower head unit 16 contained therein. FIG. 4 shows a loofah, a sponge and a brush in the various supporting members 56. Any type of shower head unit 16 could be stored in the supporting members 56. For example, additional brushes, each having different bristle hardnesses could be stored in the supporting members 56. Shower head units 16 having different water flow patterns or different flow pressures (such as high pressure flow, low pressure flow, pulsed water flow, massage flow, etc.) may be included. Alternatively, different users could store their individual shower head unit 16 in the supporting members 56. The brush, loofah and other shower head units 16 (or the labels therefor) also may be color coded to ease identification. This helps promote consumer confidence and safeguards hygiene.

The lower section 54 of the base member 50 includes a plurality of soap container supporting members 68 for holding additional soap supply containers 38. These supporting members 68 include a base surface 70 and a top surface 72. As shown in FIG. 4, the top surface 72 and base surface 70 each may be one continuous surface, wherein the plural soap container supporting members 68 are defined at various locations along the surfaces 70 and 72, in a manner similar to a test tube rack. Note also FIG. 7.

Figure 5:
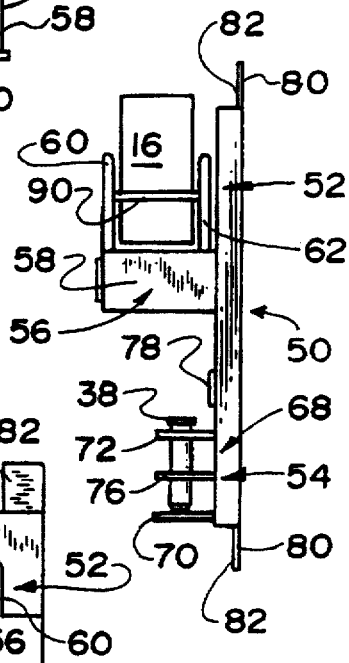
FIG. 5 is a side view of the base member of FIG. 4.

FIGS. 4 and 5 illustrate that the base surface 70 may be a single piece of suitable construction material, such as plastic. The top surface 72 may include a plurality of holes 74 defined therein, as shown in FIG. 7. The soap supply containers 38 extend between the base surface 70 and the top surface 72 such that an upper lip or cover of the soap supply container 38 remains above the top surface, while the bottom of the container 38 rests on the base surface 70. Alternatively, the upper lip or cover of the soap supply container 38 may rest on the top surface 72. An intermediate bar, wire or wall 76 may be included to provide additional support and to prevent the containers 38 from falling to the shower floor.

As mentioned above, the containers 38 may be in the form of color coded cartridges or vials. Additionally or alternatively, labels 78 (optionally color coded) can be provided on the base member 50 to identify each container 38. For example, each container 38 may include a different liquid, or different containers 38 may be provided for each different user of the shower.

The base member 50 may be mounted directly to the wall 80 of the shower stall. Mounting may be accomplished by any suitable arrangement known in the art, such as by using adhesives or mounting screws. In the illustrated embodiment, adhesive pads, such as self-adhesive double sided foam sticking tapes, are provided at or near each corner 82 of the base member 50. Alternatively, mounting screws may be driven through each of these corners 82.

FIG. 8 illustrates a typical connection of the soap dispensing shower head 10 according to the invention to the plumbing of a shower. Conventional plumbing includes a water supply pipe 22 which extends through the shower wall 80 at a face plate 84. Additional water supply pipe 22' is hidden behind the shower wall 80. The connector 20' on one end of the flexible hose 14 includes internal threads which mesh with external threads 86 located on the end of water supply pipe 22. In this manner, the connector 20' connects to the external threads 86 in a standard male/female type fitting.

The opposite end of the flexible hose 14 is connected to the support 12 of the shower head 10, as described above. The support 12 may be mounted on a shower head mounting bracket 88 which may be mounted directly to the shower wall 80. The bracket 88 may be mounted to the wall 80 in any conventional manner, such as by adhesives or by mounting screws. Alternatively, the shower head mounting bracket 88 may be provided as an integral part of the base member 50 which is shown in FIGS. 4–7.

Figure 9:
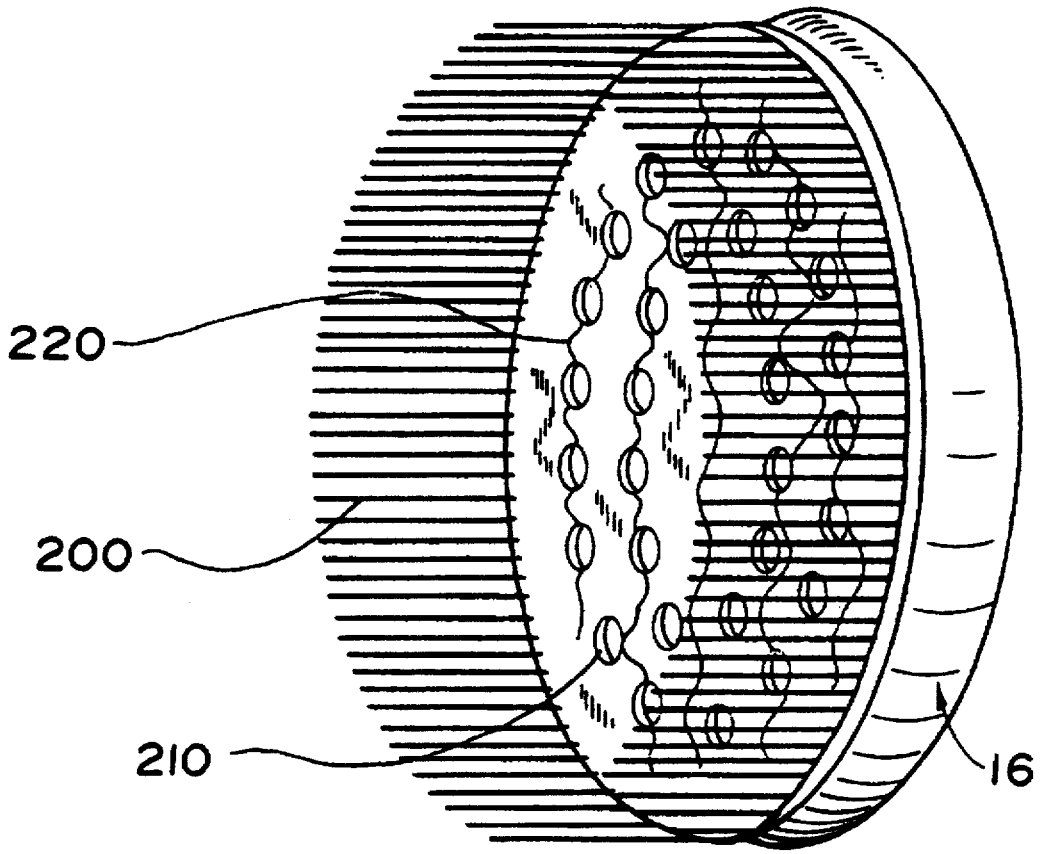
FIG. 9 illustrates a loofah scrubber which may be attached to the shower head of the invention.

FIG. 9 illustrates a detachable loofah scrubber which may be used as a shower head unit 16 in accordance with the invention. The loofah scrubber includes a brush 200, raised debriding or scouring surfaces 220 and water discharge holes 210.

The foregoing detailed description relates to a preferred embodiment of the invention. While this specification may refer to specific dimensions and various preferred features of the invention, such as bayonet type connections and male/female type connectors, these specific examples should be considered as illustrative of the invention and should not be construed as limiting the invention. Similarly, throughout this specification, the terms "soap," "soap supply" or "liquid" are used. These terms should be construed broadly so as to include a variety of liquid products, such as liquid soap, shampoo, conditioner, lotions, medications, or other emollients.

Additionally, instead of a single soap supply line 26 and soap supply valve 28, the support 12 could be supplied with a plurality of independent soap supply lines 26 which could be activated by different activation valves or buttons located on the support 12.

While the invention has been described in terms of various preferred embodiments, those skilled in the art will appreciate that various changes and modifications can be made without departing from the spirit and scope of the invention, as defined in the appended claims.

I claim:

1. A soap dispensing shower head, comprising:

a support including a hand grip unit, wherein the support has a first end and a second end and defines a connecting portion for receiving a soap supply container;

a shower head unit detachably fit to the first end of the support;

a connector at the second end of the support, wherein the connector is adapted to attach to a water supply; and a valve arrangement provided with the support, wherein the valve arrangement includes:

a soap supply line defined at least partially within the hand grip unit;

a soap valve provided in the soap supply line, a portion of the soap supply line being intermediately disposed between the connecting portion and the soap valve;

a water supply line defined at least partially within the hand grip unit;

a water valve provided in the water supply line;

a junction defined in the support where the soap supply line and the water supply line merge together to provide a fluid supply line;

wherein the soap valve and the water valve may be selectively activated to supply soap only, water only, or a mixture of soap and water, and the soap valve and the water valve each may be shut off to stop fluid flow.

2. A soap dispensing shower head according to claim 1, further including a soap supply container detachably received in the connecting portion and being in fluid communication with the soap supply line.

3. A soap dispensing shower head according to claim 2, wherein the soap supply container includes liquid soap.

4. A soap dispensing shower head according to claim 2, wherein the soap supply container includes liquid shampoo.

5. A soap dispensing shower head according to claim 2, wherein liquid from the soap supply container is fed to the soap supply line by a venturi feed arrangement.

6. A soap dispensing shower head according to claim 1, wherein the valve arrangement is located completely within the hand grip unit.

7. A soap dispensing shower head according to claim 6, further including a soap supply container received at least partially in the connecting portion, wherein the soap supply container is in fluid communication with the soap supply line.

8. A soap dispensing shower head according to claim 7, wherein liquid from the soap supply container is fed to the soap supply line by a venturi feed arrangement.

9. A soap dispensing shower head according to claim 1, wherein the junction is defined within the hand grip unit.

10. A soap dispensing shower head according to claim 1, further including a flexible hose attached to the support, wherein the flexible hose is adapted to be attached to a water supply pipe.

11. A soap dispensing shower unit, comprising:

a base member including:

a plurality of shower head unit supporting members provided on the base member; and a plurality of soap container supporting members provided on the base member; and a soap dispensing shower head including:

a support including a hand grip unit, wherein the support has a first end and a second end;

a shower head unit detachably fit to the first end of the support;

a connector at the second end of the support, wherein the connector is adapted to attach to a water supply; and a valve arrangement provided with the support, wherein the valve arrangement includes:

a soap supply line defined at least partially within the hand grip unit;

a soap valve provided in the soap supply line;

a water supply line defined at least partially within the hand grip unit;

a water valve provided in the water supply line;

a junction where the soap supply line and the water supply line merge together to provide a fluid supply line;

wherein the soap valve and the water valve may be selectively activated to supply soap only, water only, or a mixture of soap and water, and the soap valve and the water valve each may be shut off to stop fluid flow.

12. A soap dispensing shower unit according to claim 11, further including a plurality of soap supply containers received in the soap container supporting members.

13. A soap dispensing shower unit according to claim 11, further including a plurality of shower head units received in the shower head unit supporting members.

14. A soap dispensing shower unit according to claim 11, further including a soap supply container detachably received in the hand grip unit and in fluid communication with the soap supply line.

15. A soap dispensing shower unit according to claim 14, wherein liquid from the soap supply container is fed to the soap supply line by a venturi feed arrangement.

16. A soap dispensing shower unit according to claim 11, wherein the valve arrangement is located completely within the hand grip unit.

17. A soap dispensing shower unit according to claim 16, further including a soap supply container received at least partially in the hand grip unit, wherein the soap supply container is in fluid communication with the soap supply line.

18. A soap dispensing shower unit according to claim 11, wherein the junction is defined within the hand grip unit.

19. A soap dispensing shower unit according to claim 11, further including a flexible hose attached to the support, wherein the flexible hose is adapted to be attached to a water supply pipe.

20. A soap dispensing shower head, comprising:

a support having a first end and a second end and defining a connecting portion for receiving a soap supply container;

a shower head unit detachably fit to the first end of the support;

a connector at the second end of the support, wherein the connector is adapted to attach to a water supply;

a valve arrangement provided with the support, wherein the valve arrangement includes:

a soap supply line defined in the support;

a soap valve provided in the soap supply line, a portion of the soap supply line being intermediately disposed between the connecting portion and the soap valve;

a water supply line defined in the support;

a water valve provided in the water supply line;

a junction defined in the support where the soap supply line and the water supply line merge together to provide a fluid supply line;

wherein the soap valve and the water valve may be selectively activated to supply soap only, water only, or a mixture of soap and water, and the soap valve and the water valve each may be shut off to stop fluid flow; and a soap supply container is detachably received in the connecting portion and is in fluid communication with the soap supply line.

* * * * *